US005267678A

United States Patent [19]

Zuckerman

[11] Patent Number: 5,267,678

[45] Date of Patent: Dec. 7, 1993

[54] HANGER WITH U-SHAPED CLAMPS HAVING APERTURES

[75] Inventor: Andrew M. Zuckerman, Forest Hills, N.Y.

[73] Assignee: Different Dimensions Inc., Rego Park, N.Y.

[21] Appl. No.: 894,041

[22] Filed: Jun. 4, 1992

[51] Int. Cl.[5] ..... A47G 25/14

[52] U.S. Cl. ..... 223/96; 223/95; 223/85

[58] Field of Search ..... 223/96, 95, 93, 91, 223/90; 24/456, 563, 545, 555

[56] References Cited

U.S. PATENT DOCUMENTS

| | | | |
|---|---|---|---|
| D. 167,155 | 7/1952 | Leach . | |
| D. 190,843 | 7/1961 | Levine . | |
| D. 219,488 | 12/1970 | Schayer . | |
| D. 243,138 | 1/1977 | Coon . | |
| D. 246,817 | 1/1978 | Mainetti . | |
| 1,447,083 | 2/1923 | Jonas . | |
| 2,522,595 | 9/1950 | Bacica . | |
| 3,115,995 | 12/1963 | McLean . | |
| 3,406,883 | 10/1968 | Crane | 223/96 |
| 3,463,369 | 8/1969 | Moskowitz . | |
| 3,487,984 | 1/1970 | Loscalzo et al. | 223/96 |
| 3,698,607 | 10/1972 | Batts . | |
| 3,744,685 | 7/1973 | Hart . | |
| 3,755,859 | 9/1973 | Solari . | |
| 3,865,287 | 2/1975 | Peterson . | |
| 3,946,915 | 3/1976 | Crane | 223/96 |
| 4,009,807 | 3/1977 | Coon . | |
| 4,194,274 | 3/1980 | Garrison . | |
| 4,248,363 | 2/1981 | Zuckerman et al. . | |
| 4,673,151 | 6/1987 | Pelz | 24/545 X |
| 4,706,347 | 11/1987 | Lindsay . | |
| 4,738,007 | 4/1988 | Demarest, Jr. | 24/563 X |
| 4,759,480 | 7/1988 | Duester et al. . | |
| 4,807,334 | 2/1989 | Blanchard | 223/91 X |
| 5,072,866 | 12/1991 | Kolton et al. . | |
| 5,092,502 | 3/1992 | Kolton et al. . | |

*Primary Examiner*—Clifford D. Crowder
*Assistant Examiner*—Bibhu Mohanty
*Attorney, Agent, or Firm*—Amster, Rothstein & Ebenstein

[57] ABSTRACT

An improved hanger for pants and the like includes a hook portion and a clamp portion mounted on the hook portion. The clamp portion defines at least one clamp of generally inverted U-shaped configuration having a first leg, a second leg and a bight portion connecting the first and second legs. The first and second legs are biased together to clamp pants and the like therebetween, the first leg also defining an aperture therethrough to enable manual separation of the first and second legs for passage of pants and the like therebetween. The hook and clamp portions together are a one-piece construction formed exclusively of plastic in a single operation.

19 Claims, 4 Drawing Sheets

FIG. 1
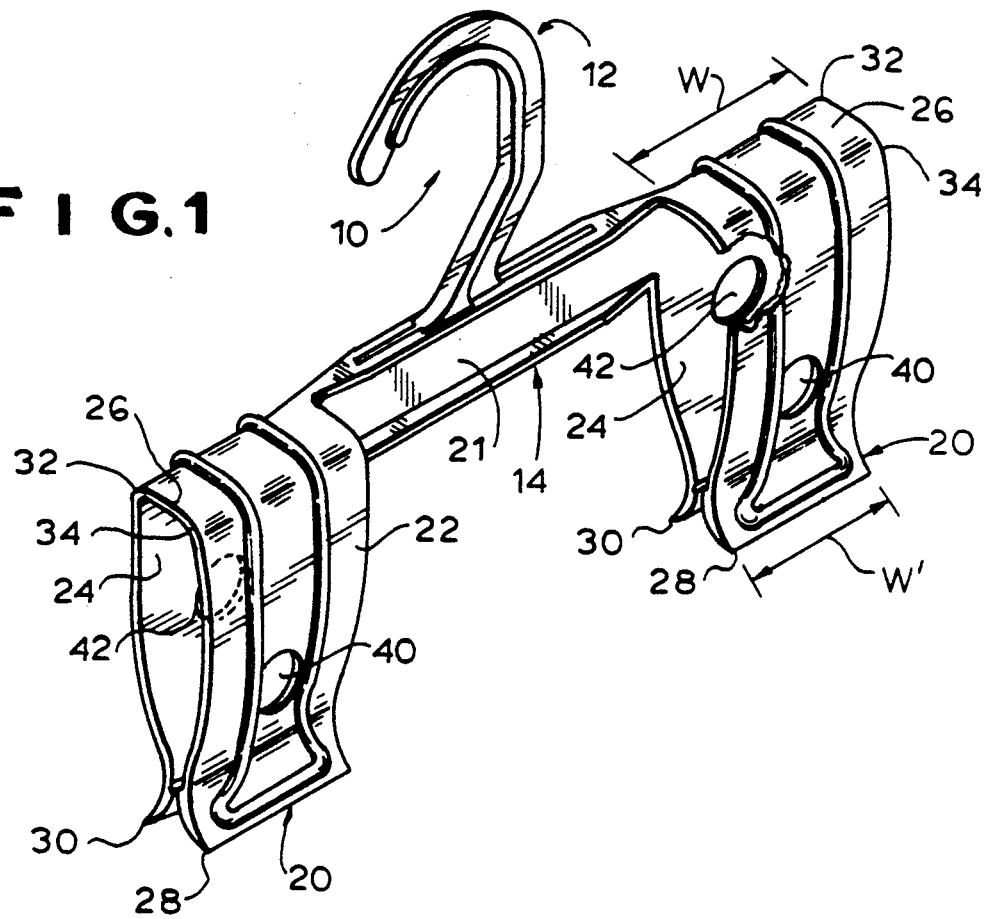
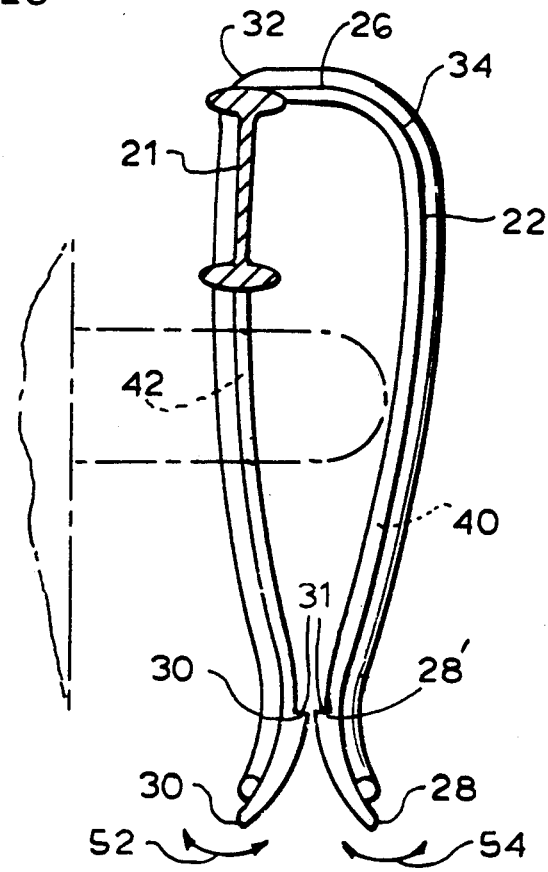
FIG. 5

HANGER WITH U-SHAPED CLAMPS HAVING APERTURES

BACKGROUND OF THE INVENTION

The present invention relates to hangers and more particularly to one-piece all-plastic hangers for pants and the like.

There exists a wide variety of different types of hangers for pants and the like (e.g., clothing with a waistband such as skirts, slacks, shorts, underwear. etc.). Typically, such a hanger includes a suspending portion (commonly in the configuration of a hook to enable the hanger to be suspended from a closet rod or the like) and a clamp portion mounted on the suspended portion and defining at least one clamp for releasably fixing the pants to the hanger. A satisfactory pants hanger must be capable of engaging and reliably supporting the weight of a pair of pants, while at the same time enabling an easy engagement and disengagement of the pants by the hanger. The pants hanger may or may not additionally include laterally extending shoulders for supporting a jacket, shirt, blouse or the like.

Some hangers provide a laterally extending arm over which the pants may be draped. However, these hangers frequently leave a visible fold mark in the pants (where the pants were folded over the arm) and, furthermore, the pants can accidentally slide off the arm. In any case, as the pants are not stretched at one end by clamp portion of the hanger and at the other end by the full weight of the pants, there is less opportunity for wrinkles and the like to "hang out."

Many of the conventional types of pants hangers are formed of metal and either wood or plastic, with the metal portion providing means for biasing the teeth of a clamp together about the pants. The incorporation of metal in these hangers, especially plastic hangers, is not desired in that extra steps are required to attach the metal pieces to the hanger and the use of metal pieces greatly increases the cost of the hanger. Further, the incorporation of metal pieces hinders recycling since the metal must be separated from the plastic portion of the hanger prior to recycling.

In all-plastic hangers, where the strong biasing provided by a metal member is not available, the clamp may utilize serrated or sharp edges to engage and support the pants, but such serrated edges can be damaging to the engaged portion of the pants during suspension and even more damaging if an attempt is made to remove the pants merely by pulling them away from the hanger without first releasing the clamp.

Other all-plastic pants hangers utilize a non-serrated clamp wherein one leg of the clamp has a large aperture and the other leg of the clamp has a detent which is biased towards and through the large aperture so that the detent disrupts the normal line of the garment and forces a portion thereof through the aperture, whereby the base of the aperture in effect supports the pants. While such a hanger does far less damage than a hanger with a serrated or sharply edged clamp, it can still lead to permanent stretching and disfigurement of the material of the pants and thus a distortion in the normal drape thereof.

In view of the foregoing disadvantages, some all-plastic hangers have forsaken entirely the concept of a clamp having two members biased together to suspend the pants and rely instead upon a ratcheted or locking clamp. In the ratcheted or locking clamp, the two legs which support the pants are either unbiased or biased apart, rather than being biased towards each other. Once the user has disposed the pants between the legs of the clamp, he forces the two legs together and deploys a ratchet or other locking mechanism to maintain them in the desired clamping position. These clamps can be difficult to employ, especially where only one hand is available for suspending the pants while at the same time forcing the legs together and applying the ratchet or locking mechanism. Furthermore, wear of the ratchet with frequent use over time can result in a failure of the reliability of the clamp.

Accordingly, it is an object of the present invention to provide a hanger for pants and the like which is all plastic.

Another object is to provide such a hanger which does not employ metal parts, serrations, sharp edges or a distortion of a portion of the pants through an aperture in order to clamp the pants.

A further object is to provide such hanger which permits easy and reliable engagement and disengagement of the pants and does not require the deployment of a ratchet or a locking mechanism.

SUMMARY OF THE INVENTION

It has now been found that the above and related objects of the present invention are obtained in a hanger for pants and the like comprising a suspending (or hook) portion and a clamp portion mounted on the suspending portion. The clamp portion defines at least one clamp of generally inverted U-shaped configuration having a first leg, a second leg and a bight portion connecting the first and second legs. The first and second legs are biased together to clamp pants and the like therebetween. The first leg may define an aperture therethrouqh to enable manual separation of the first and second legs for passage of pants and the like therebetween. The clamp portion is a one-piece construction formed exclusively of plastic in a single operation, which operation preferably also includes formation of the suspending portion.

In a preferred embodiment, the construction is also unitary and integral, and the clamp portion includes a pair of the clamps and a body connecting the clamps to the suspending portion while spacing the clamps laterally apart from one another. The clamp portion is configured and dimensioned to clamp the waistband of a pair of pants. The first and second legs have free ends which are of generally equal width and curved divergently. The first leg aperture is configured and dimensioned for passage of a finger therethrough, whereby the finger can bear on the second leg either directly or through a garment located between the two legs.

Preferably, the single operation is selected from the group consisting of molding and extrusion operations, and the plastic is selected from the group consisting of polypropylene, ABS, K Resin and polystyrene.

Where the second leg defines an aperture therethrough, the first and second leg apertures are offset from one another, and preferably both vertically aligned and vertically offset. The aperture in the second leg permits the hanger to be used with conventional garment hanging machines which spread the clamps apart to permit insertion of the garment.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawings wherein:

FIG. 1 is an isometric view of a hanger according to the present invention, taken from the front, with a portion of one of the front legs being cut away to reveal the back leg aperture;

FIGS. 5 and 6 are sectional views taken along the lines 5—5 and 6—6 of FIG. 3, respectively;

DETAILED DESCRIPTION OF THE PREFERRED EMBODIMENTS

Figure 2:
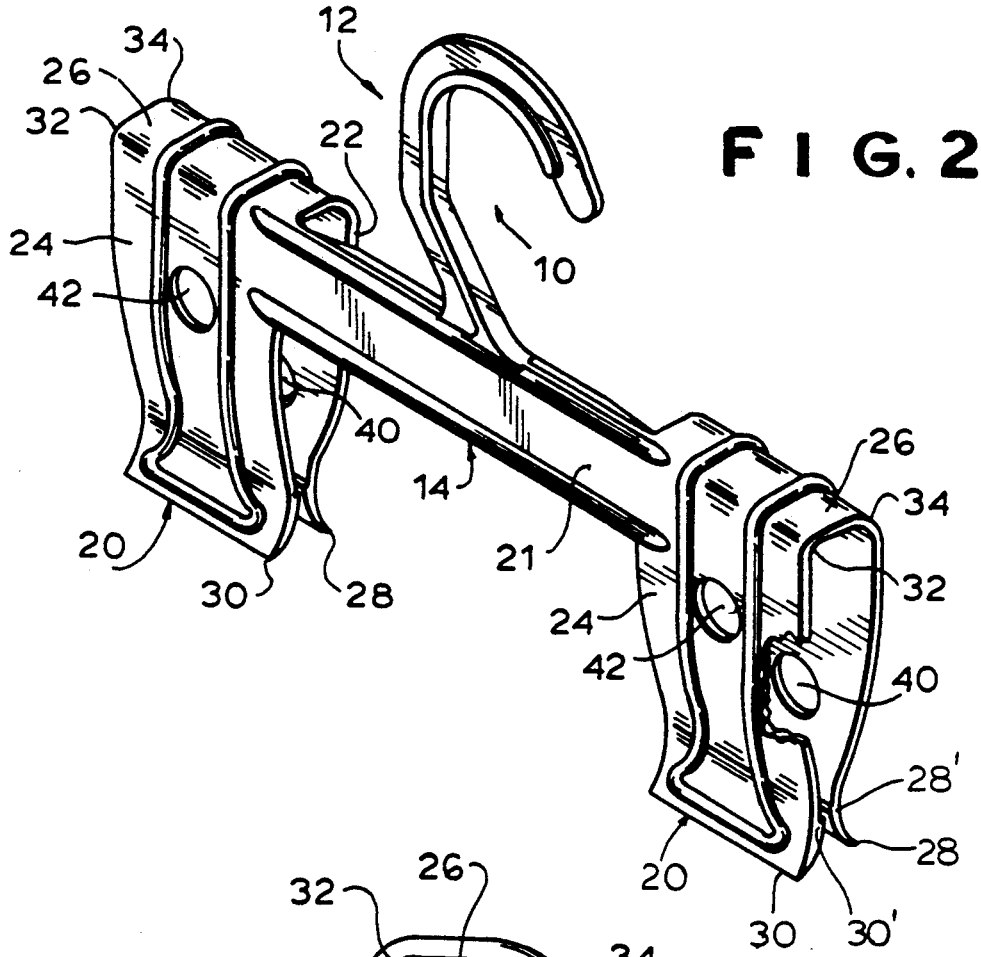
FIG. 2 is an isometric view thereof, taken from the back, with a portion of one of the back legs being cut away to reveal the front leg aperture.

Referring now to the drawings, and in particular to FIGS. 1-4 thereof, therein illustrated is a hanger for pants and the like according to the present invention, generally designated by the reference numeral 10. The hanger comprises a suspending portion generally designated 12 and a body or clamp portion generally designated 14 mounted on the suspending portion 12. The suspending and clamp portions 12, 14 together are of a one-piece construction formed exclusively of plastic in a single operation. For example, the portions 12, 14 together are preferably of a unitary, integral, one-piece construction formed exclusively of plastic (preferably polypropylene, polystyrene, ABS or K Resin) which has been molded (e.g., injection molded) or extruded in a single operation to form the hanger 10. The thickness of the hanger (i.e., the thickness of the molded or extruded plastic when viewed in cross section) may be varied, for example, to achieve a desired strength for the hanger.

More particularly, the suspending portion 12 is illustrated in the form of a hook portion configured and dimensioned to enable the hanger 10 to be suspended from a rod (not shown) or the like, as might be found in a closet. The clamp portion 14 defines at least one clamp 20 of generally inverted U-shaped configuration, two of such clamps 20 being illustrated. The inverted U-shaped configuration gives the hanger 10 minimal depth which is desirable to minimize the required storage space, especially when multiple hangers are stacked. The clamp portion 14 additionally includes a body 21, typically disposed in the plane of the suspending portion 12 in order to connect both clamps 20 to the suspending portion 12 while at the same time spacing the clamps 20 laterally apart from one another.

Figure 6:
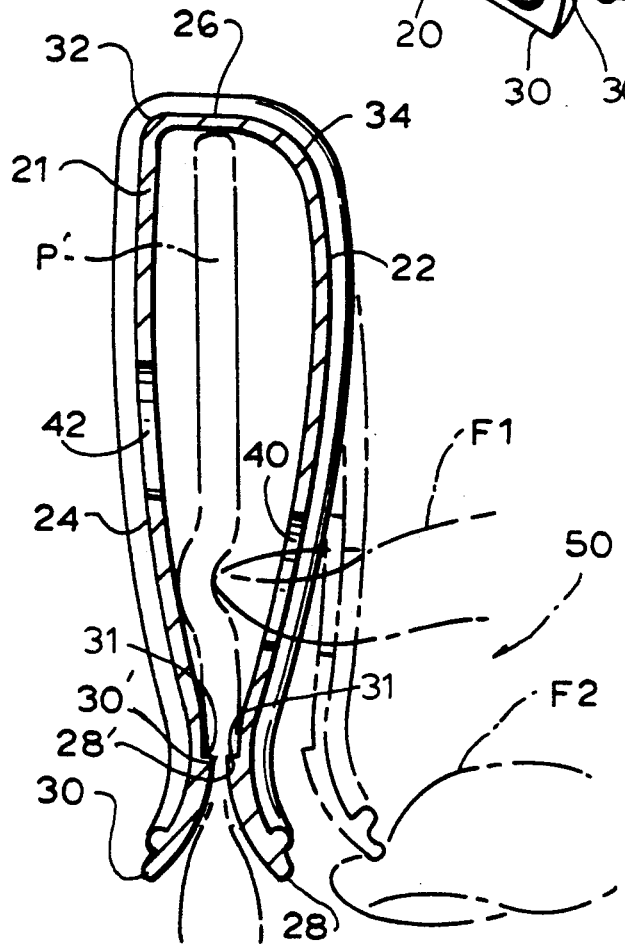
Figure 3:
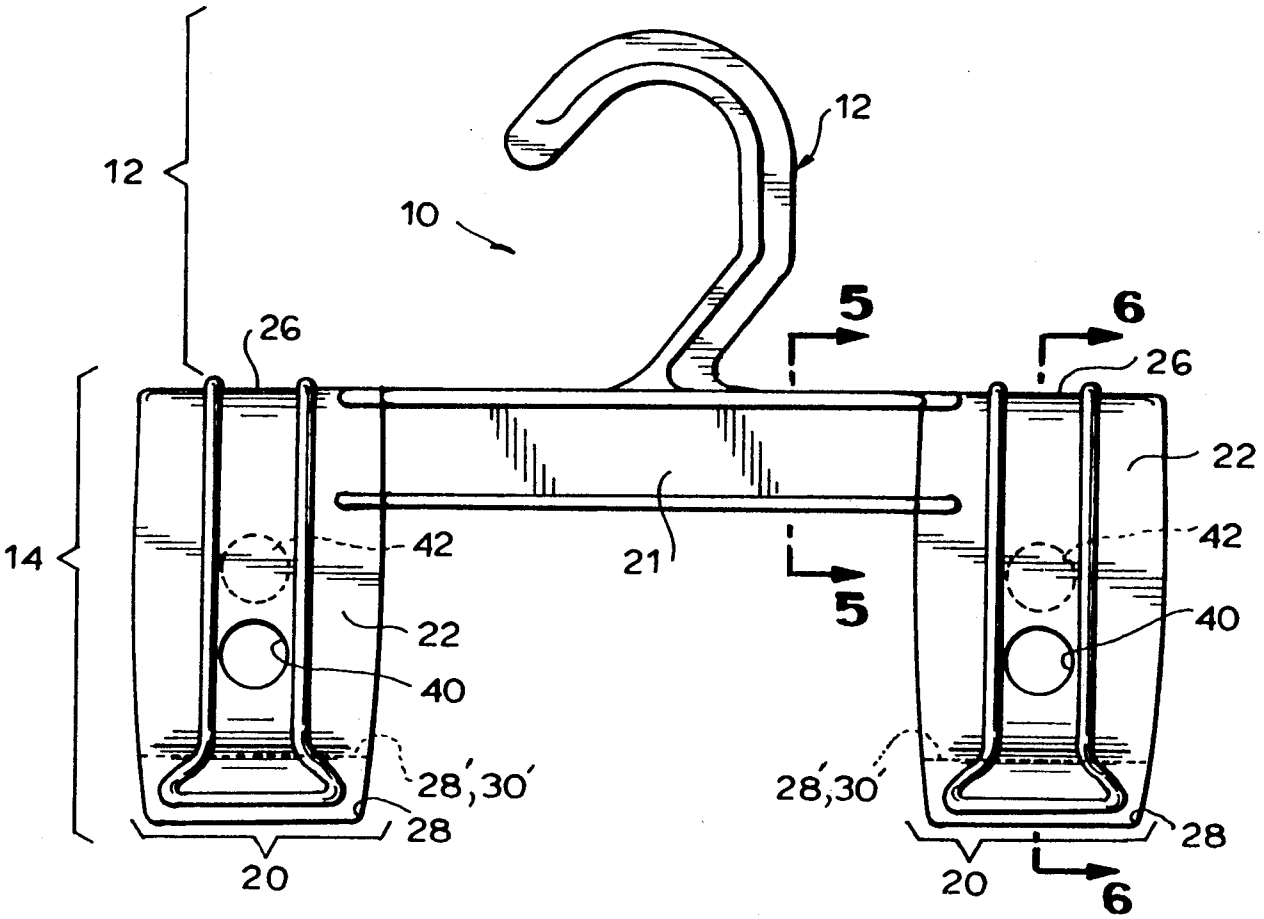
FIG. 3 is a front elevational view thereof.
Figure 4:
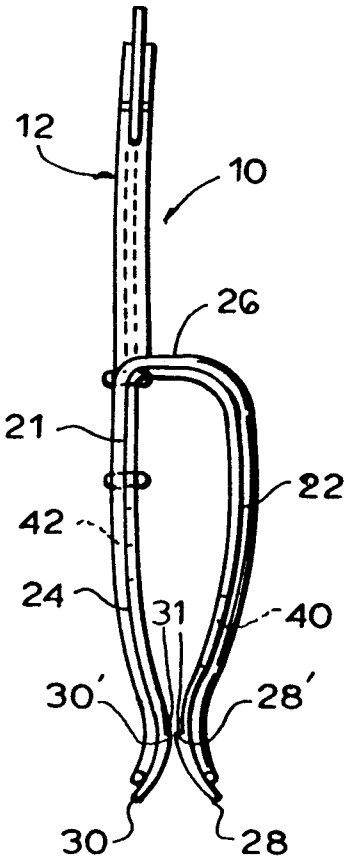
FIG. 4 is a side elevational view thereof.

Referring now to FIGS. 5 and 6 as well, each of the clamps 20 has a first or front leg 22, a second or back leg 24 and a bight portion 26 connecting the front and back legs 22, 24. Each of the front and back legs 22, 24 have free ends 28, 30, respectively, curved first convergently (that is, towards each other) at 28', 30' and then divergently (that is, away from one another) at the tips, thereby to facilitate insertion of the pants upwardly therebetween and into the clamp 20. The width W of the bight portion 26 (see FIG. 1) may be greater or lesser than the width W' of the legs 22, 24 at the free ends 28, 30 or the width of the legs 22, 24 at the point of convergence 28', 30'. Varying the width W' may be done for aesthetic reasons or to vary the amount of pressure exerted by the clamp 20 on the clothing.

Preferably, the front and back legs 22, 24 have their free ends 28, 30 (especially at the point of convergence 28', 30') of generally equal width W', so as to better grasp the pants, and unapertured, so that there is no deformation or distortion of the pants material by deformation of the pants through an aperture. Further, the front and back legs 22, 24 may each be formed with a ledge or ridge 31 at the point of convergence 28', 30', which ledge may fit underneath a waistband of a pair of pants to further support same on the hanger.

The front and back legs 22, 24 are strongly biased together at 28', 30' adjacent to and above the tips of the free ends 28, 30, respectively, in order to be able to clamp the pants and the like therebetween. The hanger 10 may be formed with a gap between the points of convergence 28', 30' or with no gap, e.g. the points 28', 30' touching (but not connected) when no garment is located therebetween. This can be achieved by controlling shrinkage after molding of the hanger 10 by varying the curing temperature.

The juncture 32 of the bight portion 26 and the back leg 24 is typically generally a right angle, while the juncture 34 of the bight portion 26 and the front leg 22 is more arcuate and rounded. As will be readily appreciated by those skilled in the plastic art, clamps having juncture points 32, 34 of different configurations may be preferred for particular applications in order to provide the desired strong but overcomable biasing of the front and back legs 22, 24 together at 28', 30'.

Referring now especially to FIG. 6, the front leg 22 defines an aperture 40 therethrough configured and dimensioned for passage of a finger F2 therethrough (at least a tip or front portion of the finger therethrough) in order to enable the front and back legs 22, 24 to be sufficiently separated to enable passage of pants and the like therebetween, as a part of the process of either inserting the pants into the clamp 20 or removing the pants from the clamp 20. Preferably, the aperture 40 is disposed on or adjacent the free end 28 of the front leg 22, so that a substantial amount of torque can be exerted on the bight portion 26 as part of the process of separating the front and back legs 22, 24. In this process the bight portion 26 flexes to permit the separating of the front and back legs 22, 24. On the other hand, the aperture 40 is disposed sufficiently above the point of convergence 28', 30' of the front and rear legs 22, 24 so that the pants themselves are not distorted and forced into the aperture 40 by the clamp pressure.

Figure 7:
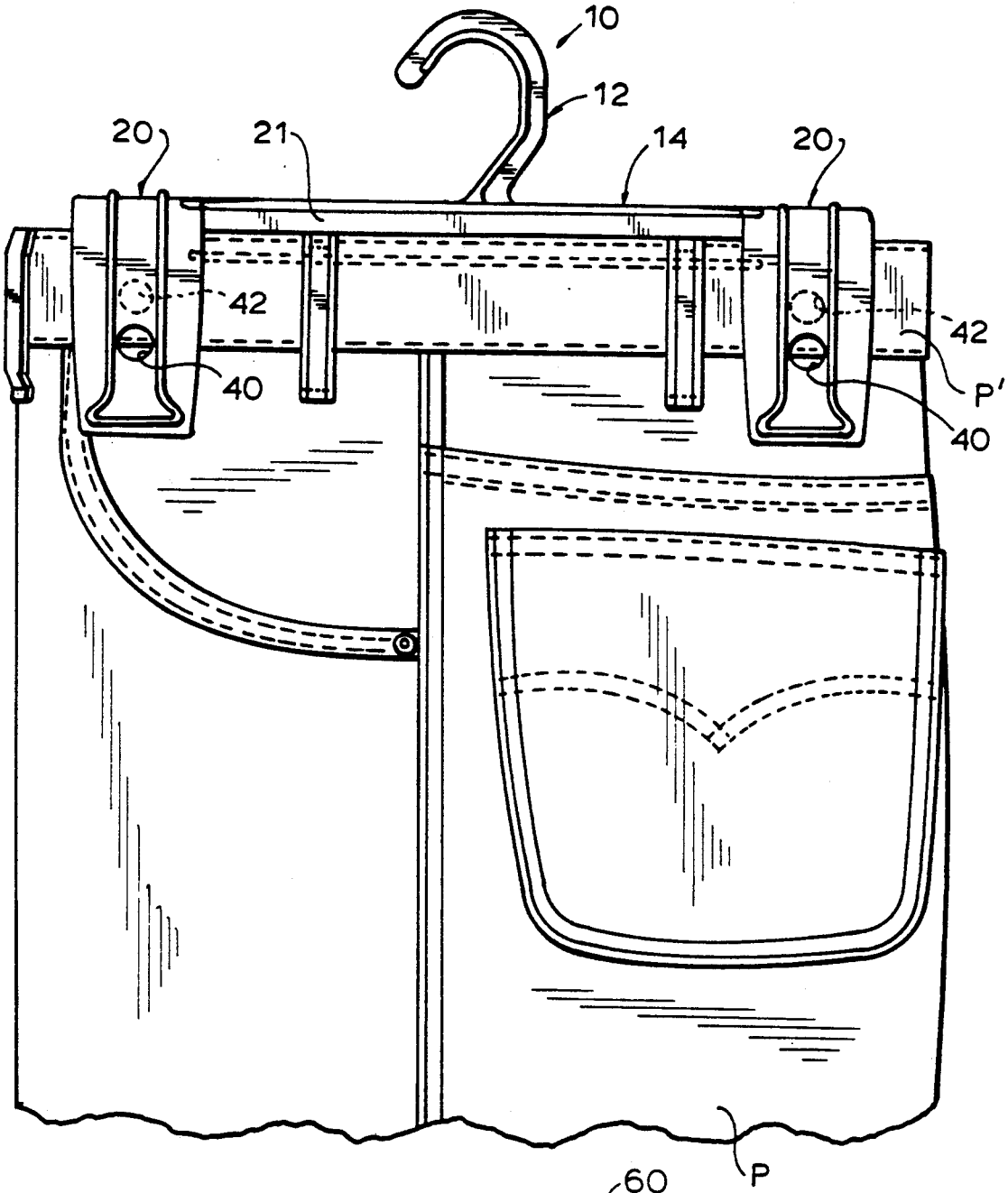
FIG. 7 is a fragmentary front elevational view of the hanger supporting a pair of pants.

Referring now to FIG. 7, therein illustrated is a hanger 10 according to the present invention as used to suspend a pair of pants P by the waistband P' thereof. The converging portions 28', 30' of the free ends 28, 30 of the front and back legs 22, 24 may grasp the pants either on or below the waistband P' thereof. If desired, the pants P may be suspended upside-down by the trouser legs instead of by the waistband P'.

Operation of the hanger, even with only one hand, is simple. If the bias of the free ends 28, 30 is too strong to enable the pants to be easily slid through the divergent portions, past the convergent portions 28', 30' and into the clamp 20 a sufficient distance to ensure their retention by the clamp 20, the user may insert a second fingertip F2 (see FIG. 6) through aperture 40 (in the direction of arrow 50) until it contacts and then displaces the back leg 24 rearwardly relative to the front leg 22 (as illustrated by double-headed arrow 52 in FIG. 5), thereby enabling the pants to be inserted upwardly past the free ends 28, 30 and the point of convergence 28', 30'. If desired, the second finger may be inserted into the aperture 40 while the thumb engages and restrains the free end 28 against displacement (that is, so that the free end 28 cannot follow the free end 30 during the displacement of back leg 24 by the second fingertip emerging from aperture 40). Conversely, the thumb may be inserted into the aperture 40 while the second finger restrains the free end 28. The free end 28 of front leg 22 may also be pulled forward (as illustrated by double headed-arrow 54) by this procedure, if desired.

More importantly, the aperture 40 provides a means for releasing the pants from the clamp 20 without stretching or tearing of the pants. As illustrated in FIG. 6, the user may simply insert the tip of his second finger F2 through the aperture 40 and apply pressure with his fingertip F2 against the pants P, and hence the back leg 24, to cause the separation between the free ends 28, 30 of the front and back legs 22, 24. At the same time, the user may situate his thumb F1 between the free ends 28, 30 to grasp the free end 28 of the front leg 22 (using his thumb F1) and easily displace it forwardly relative to the back leg 24, thereby separating the free ends 28, 30 at their point of convergence 28', 30'. Alternatively, the free end 28 may be held stationary while the user's finger tip F2 (inserted through aperture 40) displaces the back leg 30 rearwardly. The second fingertip F2 may also be used to work the pants downwardly so that the pants drop from the clamp 20 under the influence of gravity.

As such, removal of the pants results from the use of the thumb and one other finger from the same hand to separate the two free ends 28, 30 of the clamp 20. Specifically, the thumb F2 is used to pull the free end 28 of the front leg 22 away from the back leg 24 while the finger F2 pushes the back leg 24 away from the front leg 22. As the legs 22, 24 separate and the clamp 20 opens, the finger F2 may be used to "walk" the pants down past the converging portion 28', 30' of the legs and out of the clamp 20.

In order to facilitate use of a hanger 10 according to the present invention in conjunction with certain existing conventional hanger-handling equipment, it is further desirable for the back leg 24 to define an aperture 42 therethrough to receive a portion of such equipment (illustrated in phantom line in FIG. 5). The back leg aperture 42 is preferably both vertically aligned and vertically offset relative to the front leg aperture 40, the back leg aperture 42 being disposed about midway along the length of the back leg 24 and thus above the front leg aperture 40. While both apertures 40, 42 are illustrated as being of the same size, clearly the relative sizes (and indeed the configurations) of the apertures 40, 42 may be adjusted to meet the particular needs of the users and the hanger-handling equipment, respectively.

The ledges or ridges 31 of the legs 22, 24 may angled downwardly, angled upwardly or may simply extend horizontally. An upwardly angled ledge will make it more difficult to remove clothing from the clamp 20 while a downwardly angled ledge will facilitate removal. Further, the legs 22, 24 may be formed with multiple ledges of various shapes and sizes which ledges may be spaced along the length of the legs 22, 24.

Figure 8:
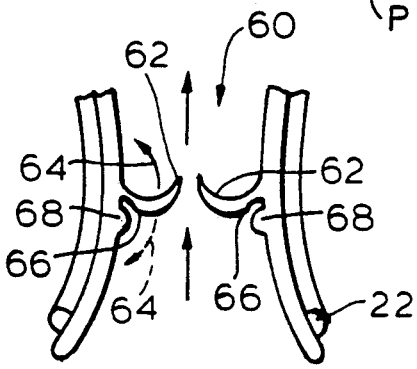
FIG. 8 is an enlarged side elevational view of the hanger of the present invention including a one way ledge.

Referring now to FIG. 8, a one-way ledge 60 may be employed on each of legs 22, 24. The ledge 60 permits the easy insertion of garments in between legs 22, 24 but inhibits removal. Specifically, the ledge 60 is formed with an upwardly extending portion 62 which portion may be of any desired shape, such as a hook. The upwardly extending portion 62 is flexibly connected to one of the legs 22, 24 such that the upwardly extending portion 62 may move in the direction of arrows 64. The upwardly extending portion 62 also includes a boss 66 formed on the lower surface thereof, which boss 66 contacts a stop 68 formed in the respective leg 22, 24 to limit the downward movement of the upwardly extending portion 62. The limited downward movement of the upwardly extending portion 62 serves to make removal of garments more difficult. The one-way ledge 60 is particularly appropriate for hanging very thin or fine garments.

To summarize, the present invention provides an all-plastic hanger for pants and the like which does not employ serrations, sharp edges or a distortion of a portion of the pants through an aperture in order to clamp the pants, yet permits easy and reliable engagement-/disengagement of the pants without deployment of a ratchet or a locking mechanism.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A hanger comprising:

(A) a suspending portion;

(B) a clamp portion connected to said suspending portion and defining at least one clamp of generally inverted U-shaped configuration having a first leg, a second leg and a bight portion connecting said first and second legs, said first and second legs being biased together to clamp an article therebetween, said first leg defining an aperture therethrough horizontally aligned with an extant portion of said second leg to enable manual separation of said first and second legs for passage of an article therebetween.

2. The hanger of claim 1 wherein said suspending and clamp portions together being a one-piece construction formed exclusively of plastic in a single operation.

3. The hanger of claim 1 wherein said first leg aperture is configured and dimensioned for passage of a finger therethrough, whereby the finger can bear on said portion of second leg.

4. The hanger of claim 1 wherein said first and second legs have free ends curved divergently.

5. The hanger of claim 1 wherein said first and second legs have free ends of generally equal width.

6. The hanger of claim 2 wherein said single operation is selected from the group consisting of molding and extrusion operations.

7. The hanger of claim 2 wherein said plastic is selected from the group consisting of polypropylene, ABS, K Resin and polystyrene.

8. The hanger of claim 1 wherein said second leg defines an aperture therethrough, said first and second leg apertures being in different horizontal planes from one another.

9. The hanger of claim 8 wherein said first and second leg apertures are both vertically aligned and vertically offset.

10. The hanger of claim 1 wherein said clamp portion is configured and dimensioned to clamp the waistband of a pair of pants.

11. The hanger of claim 1 wherein said clamp portion includes a pair of said clamps and a body connecting said clamps to said suspending portion while spacing said clamps laterally apart from one another.

12. The hanger of claim 2 wherein said construction is also unitary and integral.

13. The hanger of claim 1 wherein said second leg defines an aperture therethrough, said first and second leg apertures being in different horizontal planes from one another.

14. A hanger configured and dimensioned to clamp the waistband of a pair of pants and the like, comprising:

(A) a hook portion;

(B) a clamp portion mounted on said hook portion and defining a pair of clamps and a body connecting said clamps to said hook portion while spacing said claims laterally apart from one another, each of said clamps being of generally inverted U-shaped configuration having a first leg, a second leg and a bight portion connecting said first and second legs, said first and second legs having free ends curved divergently and of generally equal width, said first and second legs being biased together to clamp pants and the like therebetween, said first leg defining an aperture therethrough horizontally aligned with a non-apertured portion of said second leg to enable manual separation of said first and second legs for passage of pants and the like therebetween when the finger bears on said non-apertured portion of said second leg.

15. The hanger of claim 14 wherein said hook and clamp portions together being a one-piece construction formed exclusively of plastic in a single operation.

16. The hanger of claim 14 wherein said second leg defines an aperture therethrough, said first and second leg apertures being both vertically aligned and vertically offset to one another.

17. The hanger of claim 14 wherein said first and second legs include ledges.

18. The hanger of claim 14 wherein said second leg defines an aperture therethrough, said first and second leg apertures being in different horizontal planes from one another.

19. The hanger of claim 1 wherein said extant portion of said second leg is non-apertured.

* * * * *